US011083666B2

(12) United States Patent
Jeong

(10) Patent No.: US 11,083,666 B2
(45) Date of Patent: Aug. 10, 2021

(54) MASSAGE DEVICE HAVING MISALIGNED Y-SHAPED MASSAGE ROLLER SHAFTS

(71) Applicant: AMOREPACIFIC CORPORATION, Seoul (KR)

(72) Inventor: Hae Won Jeong, Seoul (KR)

(73) Assignee: AMOREPACIFIC CORPORATION, Seoul (KR)

( * ) Notice: Subject to any disclaimer, the term of this patent is extended or adjusted under 35 U.S.C. 154(b) by 279 days.

(21) Appl. No.: 15/752,556

(22) PCT Filed: Aug. 18, 2016

(86) PCT No.: PCT/KR2016/009055

§ 371 (c)(1),
(2) Date: Feb. 13, 2018

(87) PCT Pub. No.: WO2017/030376

PCT Pub. Date: Feb. 23, 2017

(65) Prior Publication Data

US 2019/0021941 A1 Jan. 24, 2019

(30) Foreign Application Priority Data

Aug. 19, 2015 (KR) ..... 10-2015-0116823

(51) Int. Cl.
*A61H 15/00* (2006.01)

(52) U.S. Cl.
CPC . *A61H 15/0092* (2013.01); *A61H 2015/0042* (2013.01); *A61H 2201/0153* (2013.01)

(58) Field of Classification Search
CPC ..... A61H 15/0092; A61H 2201/0153; A61H 2015/0042; A61H 1/006; A61H 1/007;
(Continued)

(56) References Cited

U.S. PATENT DOCUMENTS

2006/0276732 A1* 12/2006 Chen ..... A61H 15/0092 601/113
2014/0288473 A1* 9/2014 Matsushita ..... A61H 15/0085 601/137

FOREIGN PATENT DOCUMENTS

JP 2011-120893 A 6/2011
JP 2012-105701 A 6/2012
(Continued)

*Primary Examiner* — Jan Christopher L Merene
*Assistant Examiner* — Arielle Wolff
(74) *Attorney, Agent, or Firm* — Heedong Chae; Lucem, PC

(57) ABSTRACT

The present invention relates to a massage device having misaligned Y-shaped massage roller shafts and, more specifically, to a massage device having misaligned Y-shaped massage roller shafts, the device having massage roller shafts formed in a wide Y-shape at both sides of the upper end portion of a grip body and having massage rollers respectively and rotatably coupled to the massage roller shafts such that the massage roller shafts are formed to be misaligned in a narrow Y-shape when viewed from the side, and thus when massaging a wide body portion, the front side, which has the wide Y-shaped massage roller shafts, makes contact with and massages the body portion, and when massaging a narrow body portion, the lateral side, which has the narrow Y-shaped massage roller shafts, makes contact with and massages the body portion, thereby enabling various body portions having different thicknesses to be massaged.

4 Claims, 6 Drawing Sheets

(58) Field of Classification Search
CPC ..... A61H 1/008; A61H 7/00; A61H 7/001; A61H 7/002; A61H 7/003; A61H 7/004; A61H 7/005; A61H 7/007; A61H 15/00; A61H 15/0085; A61H 2015/007; A61H 2015/0014; A61H 2015/0028; A61H 2015/0064; A61H 2015/0065; A61H 2015/0066; A61H 2015/0067; A61H 2015/0068; A61H 2015/0069; A61H 2015/007; A61H 2015/0071; A61H 39/02; A61H 39/03; A61H 39/04
See application file for complete search history.

(56) References Cited

FOREIGN PATENT DOCUMENTS

| | | | | | |
|---|---|---|---|---|---|
| KR | 20-0443540 | Y1 | | 2/2009 | |
| KR | 20-0477995 | Y1 | | 8/2015 | |
| WO | WO-2014189096 | A1 | * | 11/2014 | ..... A61H 7/007 |

* cited by examiner

MASSAGE DEVICE HAVING MISALIGNED Y-SHAPED MASSAGE ROLLER SHAFTS

CROSS-REFERENCE TO RELATED APPLICATION

This application claims the benefit of Korean application No. 10-2015-0116823, filed on Aug. 19, 2015 with the Korean Intellectual Property Office, the disclosure of which is incorporated herein by reference.

TECHNICAL FIELD

The present invention relates to a massage device having misaligned Y-shaped massage roller shafts, and more specifically, to a massage device having misaligned Y-shaped massage roller shafts, in which the massage device has massage roller shafts formed in a wide Y-shape at both sides of an upper end portion of a grip body, and has massage rollers rotatably coupled to the massage roller shafts, respectively. The massage roller shafts are misaligned so as to form a narrow Y-shape when viewed from a side, so that when massaging a wide body portion, a front side, which has the wide Y-shaped massage roller shafts, makes contact with and massages the body portion, and when massaging a narrow body portion, a lateral side, which has the narrow Y-shaped massage roller shafts, makes contact with and massages the body portion, thereby enabling various body portions having different thicknesses to be massaged.

BACKGROUND ART

As a person grows older, the skin of the person loses elasticity, causing the skin to be sagged and wrinkled. In addition, when the skin is exposed to ultraviolet rays for a long period of time, dead skin cells become thicker, which causes the skin to lose its transparency, and the metabolism of the skin is reduced while moisture and nutrients are not appropriately supplied.

Skin aging occurs due to the reasons described above, and as a scheme for preventing the skin aging, a functional ingredient such as a nutritional cream that nourishes the skin may be applied to the skin, or massage, which allows the skin to maintain the elasticity by giving physical stimulation to the skin to activate the metabolism, may be performed.

The massage is derived from the Arabic word 'mass (press)' and the Greek word of 'knead'. In addition, the massage is a scheme for treating the skin or muscles with appropriate stimulation, which is intended to promote the flow of body fluids such as blood, lymphatic fluid, and tissue fluid to activate the local metabolism.

However, since the massage is performed mainly using a hand of a person, hand joints or muscles of the person performing the massage may be overloaded, and it is difficult to continuously keep a constant force for a long time.

Therefore, a massage tool produced in a specific shape is generally used in order to maintain a uniform force when performing the massage, and to prevent, a hand of a user from being loaded with fatigue.

In order to allow the user to easily use the massage tool, the massage tool is configured to have a handle generally having a cylindrical shape and a roller axially and rotatably coupled to an end of the handle, in which the roller is brought into close contact with a massage target portion and moved back and forth, so that the roller may give physical stimulation to the skin while being rotated.

As shown in FIG. 1, Korean Patent application Publication No. 2000-0051046 discloses a conventional massage tool which includes a roller 1 having a cylindrical shape, formed at one side end thereof with a coupling part, and containing jade, and a handle 3 having a support part 2 for supporting the roller 1, so that it is easy to carry the massage tool, and sufficient pressure may be applied to the massage target portion with only one hand, thereby promoting blood circulation and relieving fatigue.

However, according to the above relate art, only one roller 1 is formed on the handle 3, so that the massage is performed by bringing the roller 1 into contact with the massage target portion and moving the roller 1 while applying pressure, whereas the entire massage target portion may not be fully massaged.

In order to solve the above problem, as shown in FIG. 2, Korean Utility Model Publication No. 20-2011-0002925 discloses a massage device which includes a handle 4 configured to be gripped by a hand of a user, and two massage contact parts 5 formed on one side of the handle 4, in which the massage contact parts 5 may be rotated 360 degrees upward, downward, leftward, and rightward, so that side effects of the pressure may be reduced as much as possible during the massage, and all massage target portions may be uniformly massaged.

However, according to the above related art, the two massage contact parts 5 formed on one side of the handle 4 fully apply pressure to the massage target portion to perform the massage, but it is impossible to give stimulation by twisting a massage portion, which is one of massage techniques, and an angle between the two massage contact parts 5 may not be adjusted, so that the two massage contact parts 5 may not be applied to various body portions having different thicknesses.

DISCLOSURE

Technical Problem

To solve the problems described above, an object of the present invention is to provide a massage device having misaligned Y-shaped massage roller shafts, in which the massage device has massage roller shafts formed in a wide Y-shape at both sides of an upper end portion of a grip body, and has massage rollers rotatably coupled to the massage roller shafts, respectively. The massage roller shafts are misaligned so as to form a narrow Y-shape when viewed from a side, so that when massaging a wide body portion, a front side, which has the wide Y-shaped massage roller shafts, makes contact with and massages the body portion, and when massaging a narrow body portion, a lateral side, which has the narrow Y-shaped massage roller shafts, makes contact with and massages the body portion, thereby enabling various body portions having different thicknesses to be massaged.

In addition, an object of the present invention is to provide a massage device having misaligned Y-shaped massage roller shafts, in which the massage roller shafts are misaligned so as to stimulate a massage target portion by twisting the massage target portion, so that various massage effects may be obtained.

Technical Solution

According to the present invention, there is provided a massage device having, misaligned y-shaped massage roller shafts, the massage device including:

a grip body (10) having a predetermined length so as to be held by a hand;

a pair of massage roller shafts (30) formed at one side end of the grip body (10); and a massage roller (40) rotatably coupled to each of the massage roller shafts (30), wherein the pair of massage roller shafts (30) is misaligned such that the grip body (10) and the massage roller shafts (30) form a wide Y-shape when viewed from a front, and form a narrow Y-shape when viewed from a side.

In addition, a connection part (20) for connecting the grip body (10) to the massage roller shaft (30) may be formed between the grip body (10) and the massage roller shaft (20).

In addition, the massage roller (40) is preferably formed in a ball shape.

In addition, the grip body (10) and the massage roller shafts (30) are preferably formed of a thermosetting resin or a thermoplastic resin, in which the thermosetting resin includes at least one of an epoxy resin, an amino resin, a phenol resin, and a polyester resin, and the thermoplastic resin includes at least one of a polyethylene resin, an acrylic resin, a polypropylene resin, a polystyrene resin, a polyvinyl chloride resin, a Teflon resin, a nylon resin, and a polyacetal resin.

In addition, the massage roller (40) is preferably formed of a synthetic resin material or a metal material, in which the metal material includes at least one of iron (Fe), aluminum (Al), copper (Cu), tungsten (W), stainless steel, nickel (Ni), tin (Sn), magnesium (Mg), calcium (Ca), titanium (Ti), zinc (Zn), and gallium (Ga).

Advantageous Effects

The present invention can provide a massage device having misaligned Y-shaped massage roller shafts, in which the massage device has massage roller shafts formed in a wide Y-shape at both sides of an upper end portion of a grip body, and has massage rollers rotatably coupled to the massage roller shafts, respectively. The massage roller shafts are misaligned so as to form a narrow Y-shape when viewed from a side, so that when massaging a wide body portion, a front side, which has the wide Y-shaped massage roller shafts, can make contact with and massage the body portion, and when massaging a narrow body portion, a lateral side, which has the narrow Y-shaped massage roller shafts, can make contact with and massage the body portion, thereby enabling various body portions having different thicknesses to be massaged.

In addition, the present invention can provide a massage device having misaligned Y-shaped massage roller shafts, in which the massage roller shafts are misaligned so as to stimulate a massage target portion by twisting the massage target portion, so that various massage effects can be obtained.

BEST MODE

Mode for Invention

Hereinafter, a massage device having misaligned y-shaped massage roller shafts according to one embodiment of the present invention will be described with reference to accompanying drawings.

Figure 1:
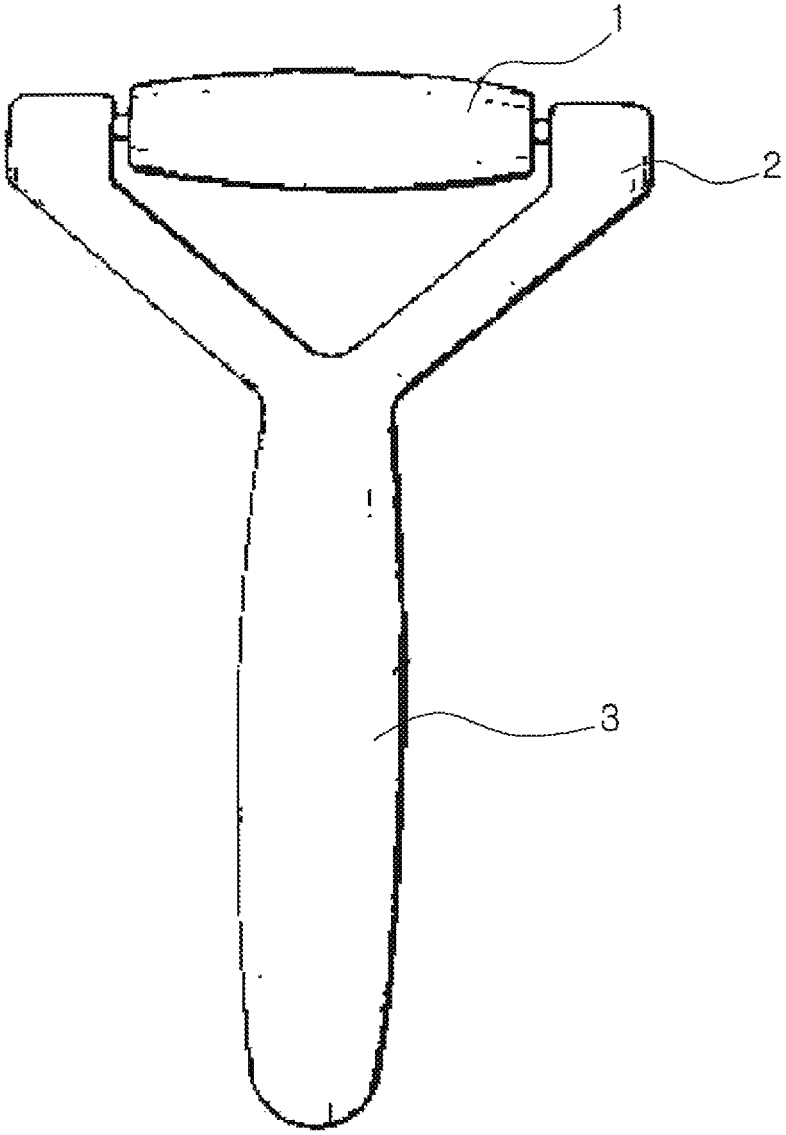
FIGS. 1 and 2 are front views of a massage device according to the related art.
Figure 2:
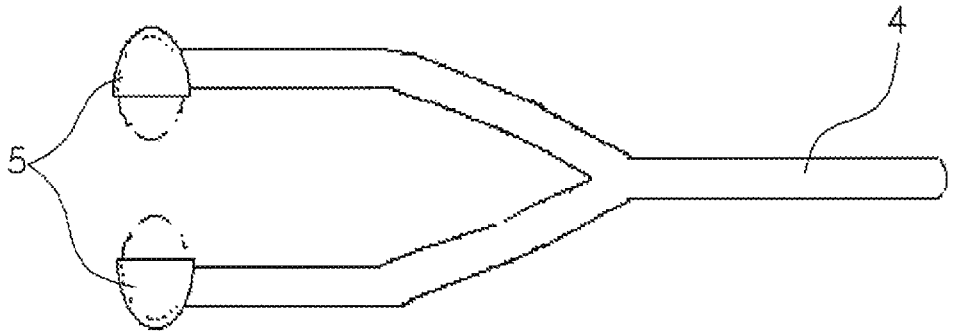
Figure 3:
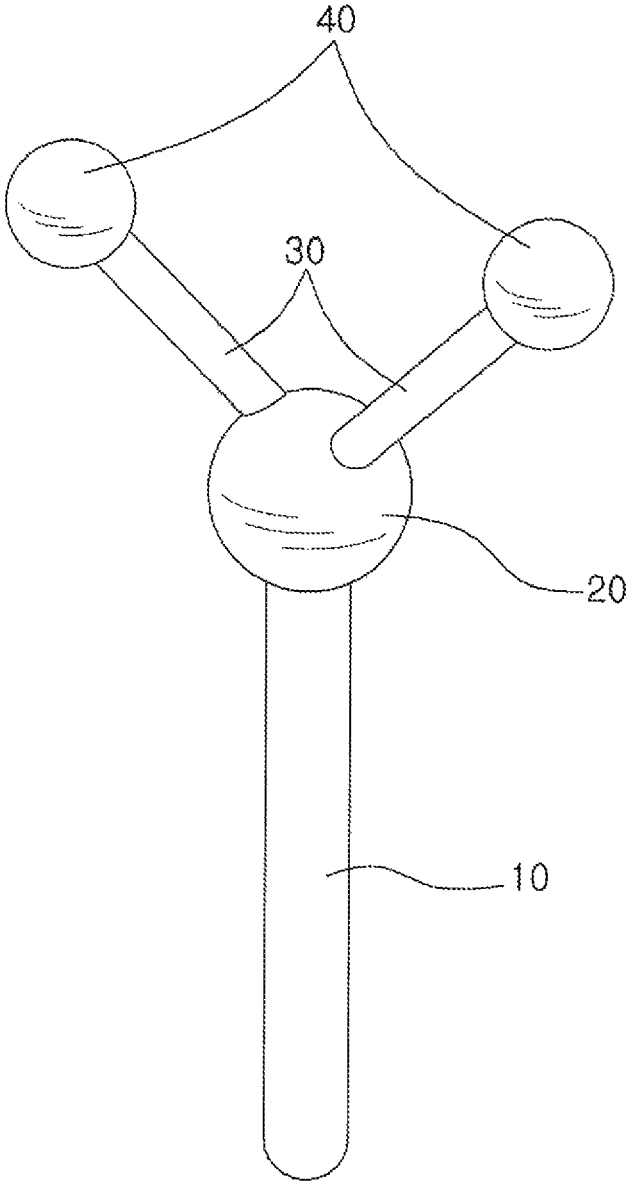
FIG. 3 is a perspective view of a massage device having misaligned y-shaped massage roller shafts according to one embodiment of the present invention.
Figure 4:
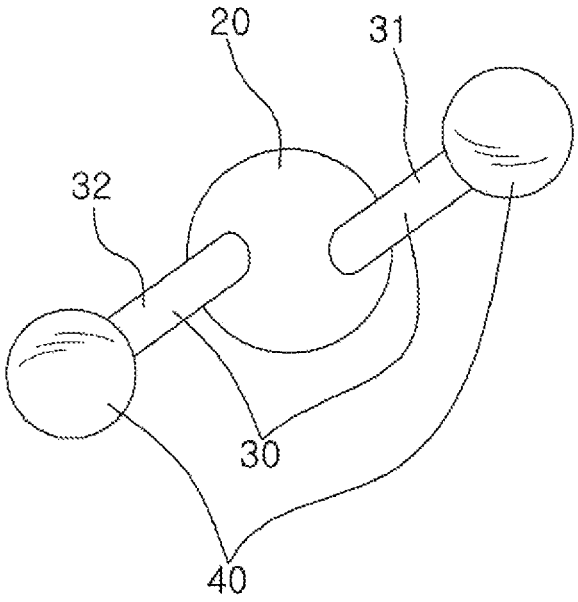
FIG. 4 is a plan view of the massage device having the misaligned y-shaped massage roller shafts according to one embodiment of the present invention.
Figure 5:
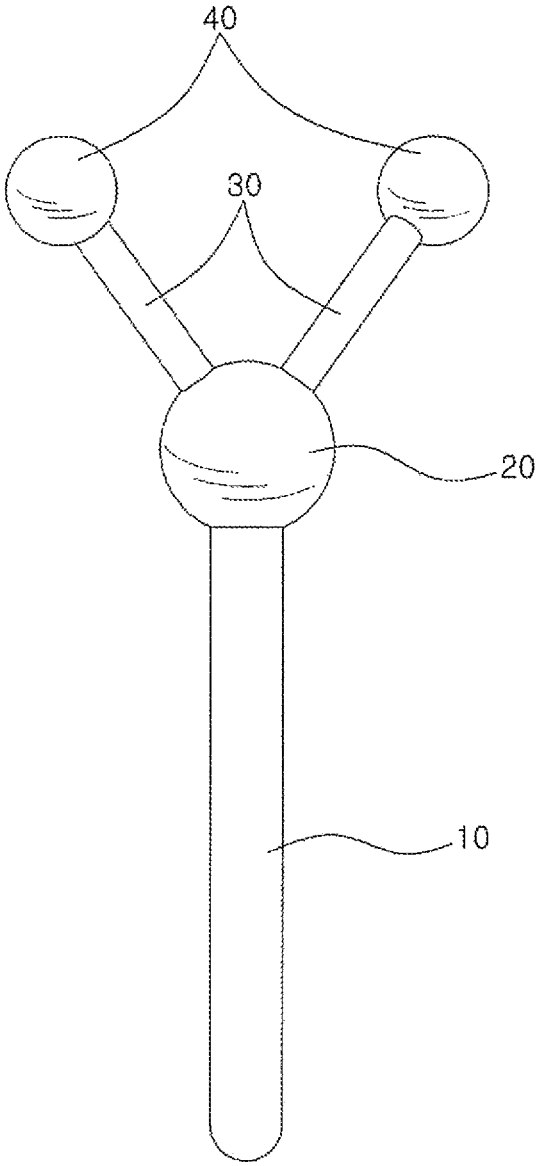
FIG. 5 is a front view of the massage device having the misaligned y-shaped massage roller shafts according to one embodiment of the present invention.
Figure 6:
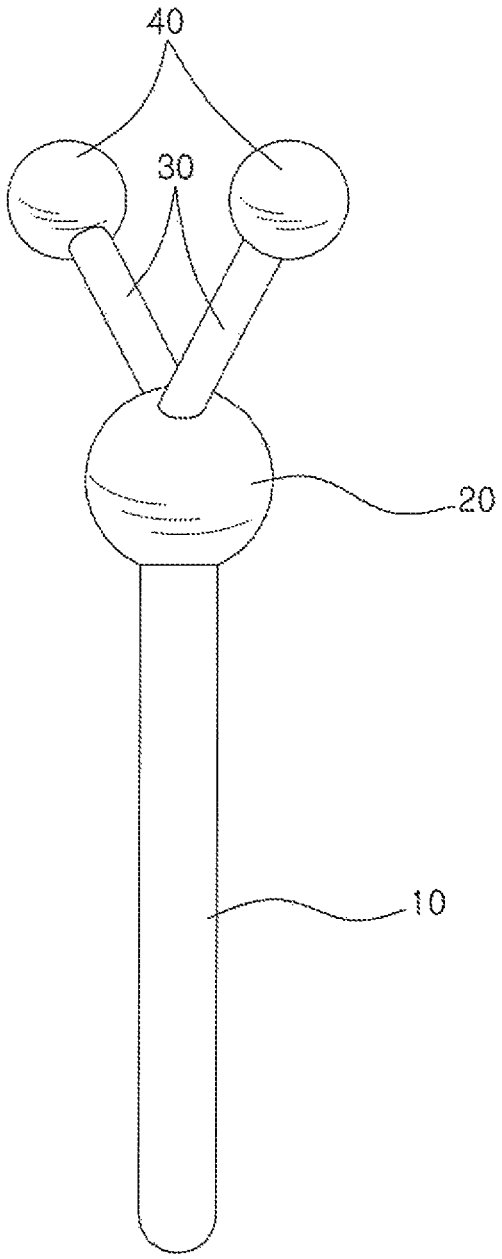
FIG. 6 is a side view of the massage device having the misaligned y-shaped massage roller shafts according to one embodiment of the present invention.

FIG. 3 is a perspective view of a massage device having misaligned y-shaped massage roller shafts according to one embodiment of the present invention, and FIG. 4 is a plan view of the massage device having the misaligned y-shaped massage roller shafts according to one embodiment of the present invention. FIG. 5 is a front view of the massage device having the misaligned y-shaped massage roller shafts according to one embodiment of the present invention, and FIG. 6 is a side view of the massage device having the misaligned y-shaped massage roller shafts according to one embodiment of the present invention.

According to the present invention, a massage device having misaligned y-shaped massage roller shafts includes a grip body 10 having a predetermined length so as to be held by a hand, a pair of massage roller shafts 30 formed at one side end of the grip body 10, and a massage roller 40 rotatably coupled to each of the massage roller shafts 30, wherein the pair of massage roller shafts 30 is misaligned such that the grip body 10 and the massage roller shafts 30 form a wide Y-shape when viewed from a front, and form a narrow Y-shape when viewed from a side.

The grip body 10 is a portion that a user grasps when using the massage device of the present invention.

A connection part 20 is formed on an upper portion of the grip body 10, and the pair of massage roller shafts 30 is formed on the connection part 20.

As shown in FIG. 4, the pair of massage roller shafts 30 is misaligned other than being arranged on a straight line as in the related art.

In other words, as shown in FIG. 4, a first massage roller shaft 31 is arranged in an upper right direction, and a second massage roller shaft 32 is arranged in a lower left direction.

Since the pair of massage roller shafts 30 is misaligned, the massage device is formed in the wide Y-shape when viewed from the front as shown in FIG. 5, and formed in the narrow Y-shape when viewed from the side as shown in FIG. 6.

When the user massages a wide body portion by using the massage device of the present invention, a front, side, which has the wide Y-shaped massage roller shafts, is rubbed against the body portion to massage the body portion.

In addition, when the user massages a narrow body portion, as shown in FIG. 6, a lateral side, which has the narrow Y-shaped massage roller shafts, is rubbed against the body portion to massage the body portion, so that the massage may be performed effectively.

According to the massage device, of the present invention, a massage target portion can be stimulated by twisting the massage target portion with the misaligned massage roller shafts 30, so that various massage effects can be obtained, and various body portions can be massaged.

The grip body 10 and the massage roller shafts 30 are preferably formed of a thermosetting resin or a thermoplastic resin, in which the thermosetting resin includes at least one of an epoxy resin, an amino resin, a phenol resin, and a polyester resin, and the thermoplastic resin includes at least one of a polyethylene resin, an acrylic resin, a polypropylene resin, a polystyrene resin, a polyvinyl chloride resin, a Teflon resin, a nylon resin, and a polyacetal resin.

The massage roller 40 is rotatably coupled to each of the massage roller shafts 30.

The massage roller 40 is formed in a ball shape, and formed of a synthetic resin material or a metal material, in which the metal material includes at least one of iron (Fe), aluminum (Al), copper (Cu), tungsten (W), stainless steel, nickel (Ni), tin (Sn), magnesium (Mg), calcium (Ca), titanium (Ti), zinc (Zn), and gallium (Ga).

In addition, when the massage roller 40 is formed of the synthetic resin material, a surface of the massage roller 40 may be plated with the metal material.

As described above, although the massage device having the misaligned y-shaped massage roller shafts according to one embodiment of the present invention has been described for illustrative purposes, the present invention is not limited thereto. It is understood that various changes and modifications can be made by those skilled in the art without departing from the spirit and scope of the present invention as disclosed in the appended claims.

DESCRIPTION OF REFERENCE NUMERALS

10: Grip body
20: Coupling part
30: Massage roller shaft
40: Massage roller

The invention claimed is:

1. A massage device having misaligned y-shaped massage roller shafts, the massage device comprising:

a grip body (10) having a predetermined length so as to be held by a hand;

a single pair of substantially straight massage roller shafts (30) and a connection part (20) for connecting the grip body to the massage roller shafts formed at one end of the grip body (10); and a massage roller (40) rotatably coupled to each of the massage roller shafts (30), wherein the single pair of massage roller shafts (30) comprises a first massage roller shaft (31) and a second massage roller shaft (32), wherein the massage roller shafts are misaligned from each other such that the massage roller shafts (30) form a wide y-shape when viewed form a front view, and form a narrow y-shape when viewed form a side view, and wherein the first massage roller shaft (31) and the second massage roller shaft (32) are arranged such that a central axis of the first massage roller shaft and a central axis of the second massage roller shaft are not both arranged on a single straight line and do not intersect when viewed from a plan view, wherein the wide y-shape is configured to massage first body portions and the narrow y-shape is configured to massage second body portions that are narrower than the first body portions, and wherein the misaligned y-shaped massage roller shafts are configured to twist body portions to be massaged.

2. The massage device of claim 1, wherein each massage roller (40) is formed in a ball shape.

3. The massage device of claim 1, wherein the grip body (10) and the massage roller shafts (30) are formed of a thermosetting resin or a thermoplastic resin, in which the thermosetting resin includes at least one of an epoxy resin, an amino resin, a phenol resin, and a polyester resin, and the thermoplastic resin includes at least one of a polyethylene resin, an acrylic resin, a polypropylene resin, a polystyrene resin, a polyvinyl chloride resin, a Teflon resin, a nylon resin, and a polyacetal resin.

4. The massage device of claim 1, wherein each massage roller (40) is formed of a synthetic resin material or a metal material, in which the metal material included includes at least one of iron (Fe), aluminum (Al), copper (Cu), tungsten (W), stainless steel, nickel (Ni), tin (Sn), magnesium (Mg), calcium (Ca), titanium (Ti), zinc (Zn), and gallium (Ga).

* * * * *